US006880508B2

(12) United States Patent
Tanaka et al.

(10) Patent No.: US 6,880,508 B2
(45) Date of Patent: Apr. 19, 2005

(54) START ASSISTER OF FUEL INJECTION PUMP

(75) Inventors: Masamichi Tanaka, Osaka (JP); Junichi Samo, Osaka (JP); Satoshi Hattori, Osaka (JP); Tohru Ogawa, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 10/793,037

(22) Filed: Mar. 5, 2004

(65) Prior Publication Data

US 2004/0197198 A1 Oct. 7, 2004

Related U.S. Application Data

(63) Continuation of application No. PCT/JP02/08354, filed on Aug. 19, 2002.

(30) Foreign Application Priority Data

Sep. 28, 2001 (JP) ..... 2001-300938
Sep. 28, 2001 (JP) ..... 2001-300939

(51) Int. Cl.[7] ..... F02M 33/05
(52) U.S. Cl. ..... 123/179.17
(58) Field of Search ..... 123/179.16–179.17, 123/500–502, 506

(56) References Cited

U.S. PATENT DOCUMENTS 4,273,090 A * 6/1981 Hofer et al. ..... 123/502
4,333,437 A * 6/1982 Lohner et al. ..... 123/502
4,373,492 A * 2/1983 Konrath et al. ..... 123/502
4,395,990 A * 8/1983 Hofer et al. ..... 123/502
4,489,698 A * 12/1984 Hofer et al. ..... 123/502
4,586,480 A * 5/1986 Kobayashi et al. ..... 123/506
4,838,232 A * 6/1989 Wich ..... 123/506
5,740,782 A * 4/1998 Lowi, Jr. ..... 123/446
5,848,581 A * 12/1998 Hirose et al. ..... 123/357

OTHER PUBLICATIONS

Patent Abstracts of Japan. Publication No.: 2000–234576, Date of Publication: Aug. 29, 2000; Title: Injection Timing Control Structure of Fuel Injection Pump.

* cited by examiner

*Primary Examiner*—Thomas Moulis
(74) *Attorney, Agent, or Firm*—Sterne, Kessler, Goldstein & Fox P.L.L.C.

(57) ABSTRACT

A start assister (10) of a fuel injection pump, comprising a piston (46) inlayed into a housing (H), an upper chamber (49) formed over the piston (46), lower chamber (48) formed under the piston (46), wherein a sub port (42) is opened and closed by sliding of the piston (46), and a fuel injection timing is advanced by closing the sub port (42). A thermo-element (61) for sliding the piston is arranged on one side of the piston (46) in sliding direction. A telescopic pin (61*a*) of the thermo-element (61) is arranged in a low-pressure chamber (50) divided into the upper chamber and the lower chamber, and a connection pin (62) is interposed between the telescopic pin (61*a*) and the piston (46).

6 Claims, 10 Drawing Sheets

When the upper and lower chambers with the timer piston between communicate with the fuel gallery through a bore or the like.

(a)

When the upper and lower chambers with the timer piston between communicate with the fuel gallery through only the inlay-gap.

(b)

START ASSISTER OF FUEL INJECTION PUMP

TECHNICAL FIELD

The present invention relates to a structure of a start assister of a fuel injection pump.

BACKGROUND ART

Conventionally, there is a well-known start assister of a fuel injection pump comprising a start-advancing mechanism for advancing a fuel injection timing by closing a sub port in a plunger part of the fuel injection pump.

This conventional start assister has a drain passage formed in a housing to be connected to the sub port. The drain passage is opened and closed, i.e., the sub port is opened and closed by a peripheral portion of the piston, wherein the fuel injection timing is advanced by closing the sub port.

An actuator such as a temperature-sensing member, a solenoid, or the like is installed in the start assister. The sliding of the piston for opening and closing the sub port depends on expansion and contraction movement of a pin of the actuator.

In the housing are formed upper and lower chambers over and under the piston, and bored respective passages for connecting the upper and lower chambers to a fuel gallery.

With respect to the conventional start assister having a temperature-sensing member serving as the actuator, the pin of the temperature-sensing member is arranged in higher-pressured one of the upper and lower chambers over and under the piston. Therefore, the temperature-sensing member is subjected to change of pressure in the corresponding chamber and liable to be permeated by fuel oil in the corresponding chamber, thereby being possible to be damaged or deteriorated.

The temperature-sensing member, solenoid, or the like, serving as the actuator, is fixedly installed in the housing. The standardized start assister is unable to have the installed actuator replaced with another type actuator, thereby being difficult to correspond to various demands.

Moreover, even when the sub port is closed by the piston, fuel oil in a fuel oil chamber pressurized by a plunger leaks and flows into the upper and lower chambers over and under the piston from an inlay-gap between the housing and piston through the drain passage and the bores connecting the upper and lower chambers to the fuel gallery, so that the advance of fuel injection timing may be insufficient.

To prevent the fuel leak into the upper and lower chambers, the inlay-gap between the housing and piston requires complicated processing and management as precise as the inlay-gap between the plunger and the plunger barrel.

SUMMARY OF THE INVENTION

According to the present invention, a start assister of a fuel injection pump comprises a piston slidably installed in a housing, an upper chamber formed over the piston, a lower chamber formed under the piston, and a sub port opened and closed by sliding of the piston, wherein a fuel injection timing is advanced by closing the sub port. The start assister is characterized by a temperature-sensing member for sliding the piston being arranged on one side in the piston-sliding direction, a telescopic pin of the temperature-sensing member arranged in a low-pressure chamber divided into the upper chamber and the lower chamber, and a connection pin interposed between the telescopic pin and the piston.

Accordingly, fuel oil is prevented from entering a gap between the telescopic pin and a sleeve pushing out the telescopic pin or the inside of the temperature-sensing member. Therefore, timings of opening and closing the sub port are stabilized, and the temperature-sensing member is prevented from being functionally deteriorated or damaged so as to enhance its reliability. The connection pin connecting the piston to the telescopic pin of the temperature-sensing member may be suitably selected in its diametrical size so as to reduce fluctuation of pressure in the upper and lower chambers causing load on the temperature-sensing member, thereby preventing functional deterioration and damage of the temperature-sensing member and enhancing its reliability.

According to the present invention, a stopper may be formed by either the telescopic pin or the connection pin so as to prevent the telescopic pin from being contracted shorter than its telescopic stroke.

Therefore, the interior of the temperature-sensing member, such as a sleeve, is free from thrust force from the connection pin in the contracting direction, thereby preventing functional deterioration and damage of the temperature-sensing member and enhancing its reliability.

According to the present invention, a seal member may be interposed between the stopper and the temperature-sensing member so as to seal an inside of a main body of the temperature-sensing member from the lower-pressure chamber.

Therefore, fuel oil is prevented from entering a gap between the telescopic pin and sleeve in the temperature-sensing member. Entrance of fuel oil into the gap between the telescopic pin and sleeve causes fluctuation of bottom end position of the contracted telescopic pin so as to change timings of opening and closing the sub port. The present arrangement prevents the permeation of fuel oil into the temperature-sensing member causing functional deterioration and damage of the temperature-sensing member, thereby enhancing reliability of the temperature-sensing member.

According to the present invention, a start assister of a fuel injection pump comprises function members. A piston slidably inlayed into a housing, and an actuator installed in the housing so as to slide the piston serve as the function members. A temperature-sensing member, a solenoid or the like serves as the actuator. A sub port is opened and closed by sliding of the piston. A fuel injection timing is advanced by closing the sub port. The function members installed in the housing are optionally exchangeable.

Therefore, structures of advancing fuel injection timing can be applied corresponding to various uses.

According to the present invention, the function members of the start assister may be assembled together so as to make a unit detachably installed in the housing.

Therefore, the units can be provided so that each of them ensures its function and precision, thereby enhancing its reliability. The units having different actuators such as the temperature-sensing member and the solenoid can be prepared corresponding to various uses, and one of the units is selectively installed so as to provide a suitable structure of advancing fuel injection timing.

According to the present invention, a start assister of a fuel injection pump comprises: a sub port for draining a part of fuel oil admitted into a plunger barrel from a fuel gallery;

a drain passage connected to the sub port; a piston for opening and closing the drain passage being slidably inlayed into a housing so as to have an inlay-gap between the piston and the housing, wherein the piston closes the sub port so as to advance fuel injection timing; an upper chamber formed over the piston; and a lower chamber formed under the piston. The upper chamber and the lower chamber communicate with the fuel gallery through only the inlay-gap between the housing and the piston.

When the sub port is closed, fuel injection pressure leaks out through the inlay-gap and accumulated in the lower and upper chambers, thereby easily increasing the pressure in the fuel-compression chamber so as to have sufficient effect of advancing fuel injection timing.

According to the present invention, while the fuel gallery is open toward a side surface of the piston, a high-pressure chamber may be formed in the housing so as to be open toward a side surface of the piston opposite to the fuel gallery and to communicate with the upper chamber and the lower chamber through the inlay-gap between the housing and the piston.

Therefore, the piston can be pressed against an inner side surface of the inlay hole facing the open side of the fuel gallery so as to improve the sealing of the lower and upper chambers from the fuel gallery, thereby keeping the pressure accumulated in the lower and upper chambers and enhancing the efficiency of advancing fuel injection timing. Even if the volume of the inlay-gap between the inlay-hole and the piston changes, the enhanced sealing between the fuel gallery and the upper and lower chambers is still ensured so as to have steady property of advancing fuel injection timing.

BEST MODE OF CARRYING OUT THE INVENTION

Figure 1:
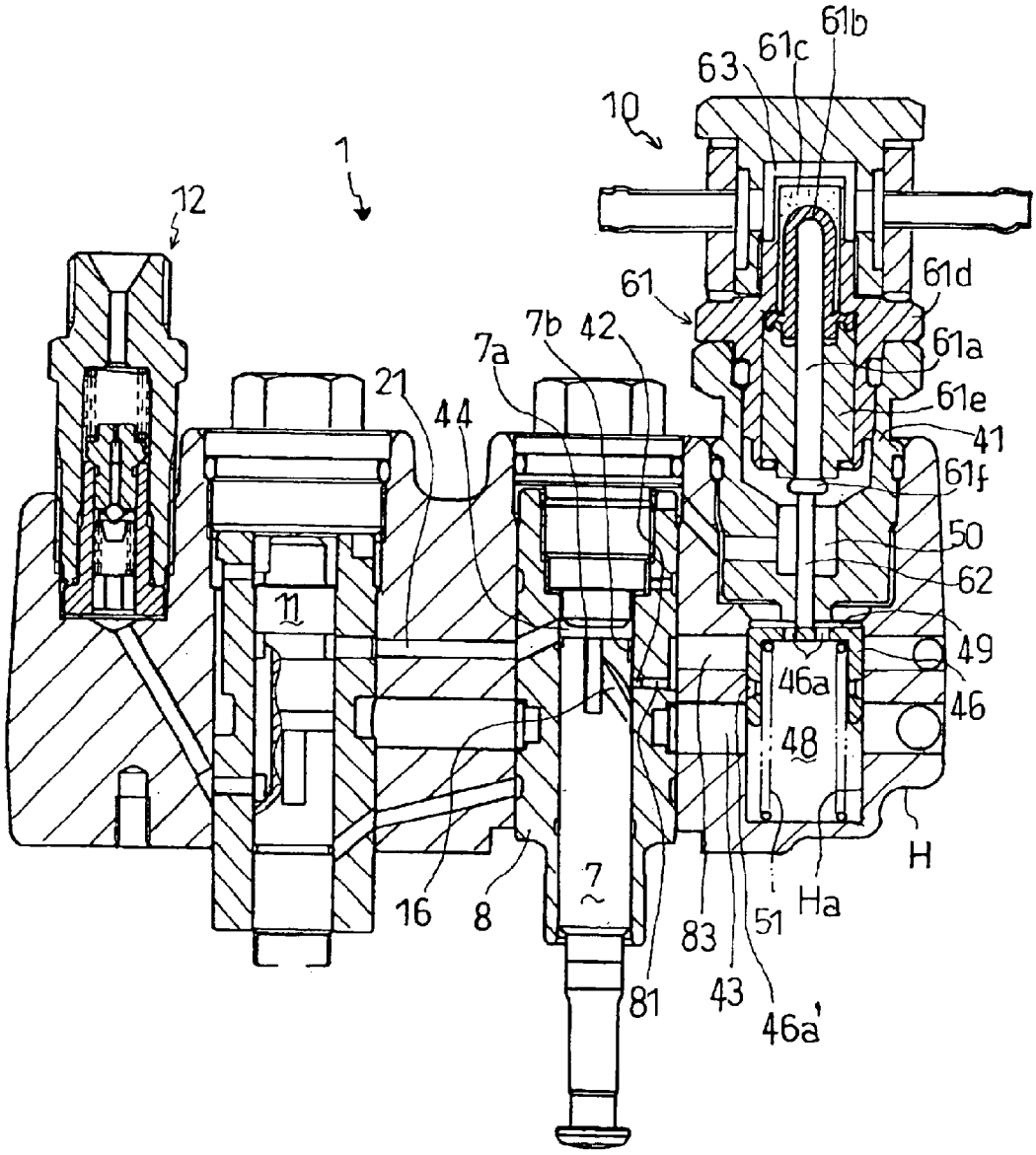
FIG. 1 is a sectional side view of a fuel injection pump equipped with a start assister according to the present invention when a sub port is closed.

Embodiments of the present invention will be described with reference to attached drawings.

Firstly, an outline of a structure of a fuel injection pump comprising a start assister according to the present invention will be described. Referring to a fuel injection pump shown in FIG.1 and FIG.2, a plunger barrel 8 is inlaid into a housing H, and a plunger 7 is vertically slidably inserted in the plunger barrel 8.

The plunger 7 is biased downward and vertically reciprocated by rotating cam (not shown) below the plunger 7. Fuel oil reserved in a fuel tank is supplied to a fuel gallery 43 by a trochoid pump.

Inside the plunger barrel 8, a fuel-compression chamber 44 for applying pressure to the inducted fuel is formed above the plunger 7. A main port (not shown) formed in the plunger barrel 8 can be brought into communication with the fuel-compression chamber 44. The main port communicates with the fuel gallery 43 through a fuel-supply oil passage so as to be constantly supplied with fuel.

Fuel inducted into the fuel-compression chamber 44 from the fuel gallery 43 through the main port is pressurized by the plunger 7 sliding upward so as to be discharged to a distributor shaft 9 through a fuel-discharging passage 21. Fuel oil is distributed to plural delivery valves 12 by rotating the distributor shaft 9, and the fuel oil supplied to each of the delivery valves 12 is discharged to an injection nozzle so as to be injected.

A reference numeral 16 designates a plunger lead for setting an effective stroke of the plunger 7 on discharging fuel. By rotating the plunger 7 around its axis, the height of the plunger 7 when bringing the plunger lead 16 into communication with the main port can be changed.

A sub port 42 is formed in the plunger barrel 8, and a sub lead 7*b* is formed at a top portion 7*a* of the plunger 7, so that the sub lead 7*b* can be brought into communication with the sub port 42 at a certain rotation range of the plunger 7.

In case the main port (not shown) formed in the plunger barrel 8 is closed by an outer peripheral surface of the plunger 7, the fuel compression-chamber 44 may be brought into communication with the sub port 42 through the sub lead 7*b*.

An inlay-hole Ha is bored downward in the housing H beside the plunger barrel 8.

A space under the piston 46 in the inlay-hole Ha is made as a lower chamber 48, and a space over the piston 46 is made as an upper chamber 49. The lower chamber 48 communicates with the upper chamber 49 through a communication hole 46*a* formed at the top surface of the piston 46. The lower chamber 48 communicates with the fuel gallery 43.

An oil passage 81 in communication with the sub port 42 is arranged in the radial direction in the plunger barrel 8, and the oil passage 81 communicates with the inlay-hole Ha through a drain passage 83 formed in the housing H.

The piston 46 is biased upward by a spring 51. A thermo-element 61 serving as a temperature-sensing member is arranged above the piston 46, and it is fastened to a supporter 41 inserted into the inlay-hole Ha.

To constitute the thermo-element 61, wax 61*c* having mobility is inclosed in a main body 61*d* of the thermo-element 61, and the wax 61*c* is sealed by a sleeve 61*b* made of elastic material. Into a cylindrical hollow formed in the sleeve 61*b* is slidably fitted a telescopic pin 61*a*. The pin 61*a* is axially movably supported in a cover 61*e* of the main body 61*d*.

Figure 2:
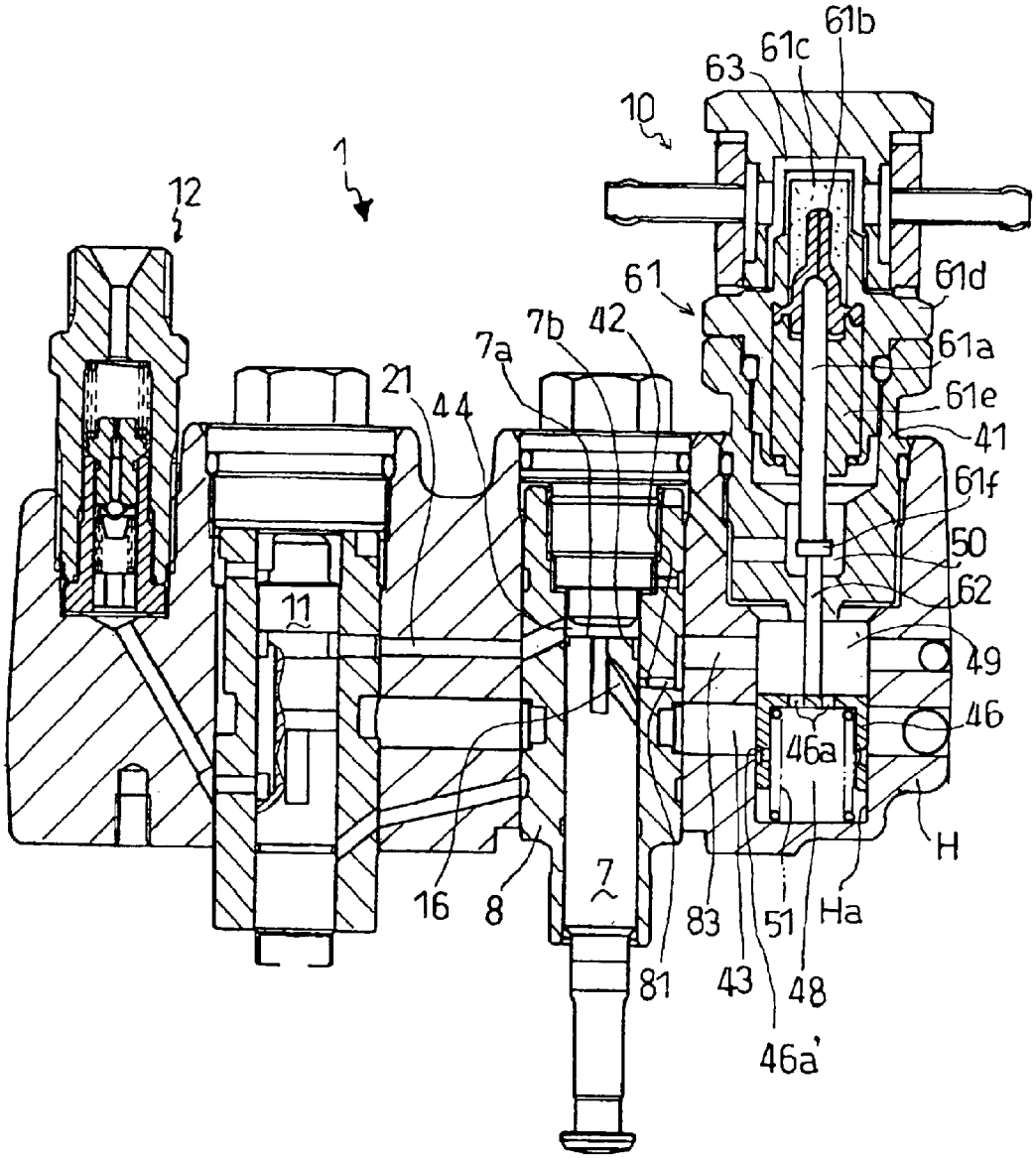
FIG. 2 is a sectional side view of the fuel injection pump equipped with the starter assister according to the present invention when the sub port is opened.

As shown in FIG. 1, when the temperature is low, the telescopic pin 61*a* is contracted. When wax 61*c* swells according to temperature rise, pressure is applied onto the sleeve 61*b* so as to push out the pin 61*a*, thereby extending the pin 61*a*, as shown in FIG. 2.

In addition, a cooling water chamber 63 through which cooling water flows is formed around the portion of the main body 61*d* enclosing the wax 61*c*, so that the expansion/contraction of the wax 61*c* depends on the temperature of cooling water flowing through the cooling water chamber 63.

The thermo-element 61 has the telescopic pin 61*a* extended downward, and the telescopic pin 61*a* abuts against the top surface of the piston 46 with a connection pin 62 between the telescopic pin 61*a* and the top surface of the piston 46.

Accordingly, when the telescopic pin 61*a* is contracted by low temperature, as shown in FIG.1, the piston 46 biased by the spring 51 slides upward. When the telescopic pin 61*a* is extended by high temperature, as shown in FIG.2, the piston 46 slides downward with the connection pin 62.

A low-pressured chamber 50 connected to a fuel tank is formed inside the supporter 41 supporting the thermo-element 61. The telescopic pin 61*a*, the main body 61*d*, and the cover 61*e* are disposed at their lower end portions in the low-pressured chamber 50.

The supporter 41 separates the low-pressured chamber 50 from the upper and lower chambers 49 and 48 in communication with the high-pressured fuel gallery 43.

The fuel gallery 43 has an opening toward the inlay hole Ha so as to communicate with the lower chamber 48.

The drain passage 83 also has an opening toward the inlay hole Ha, which is closed by a side surface of the upwardly slid piston 46 shown in FIG. 1.

Therefore, the upwardly slid piston 46 separates the fuel gallery 43 from the drain passage 83. If the telescopic pin 61*a* of the thermo-element 61 is extended to slide the piston 46 downward as shown in FIG. 2, the drain passage 83 is opened to the upper chamber 49 so as to be brought into communication with the fuel gallery 43 through the communication hole 46*a* and a communication hole 46*a*' formed at the side surface of the piston 46.

Thus, a start assister 10 of the fuel injection pump 1 comprises the piston 46, the lower chamber 48, the upper chamber 49, the low-pressured chamber 50, the thermo-element 61, the spring 51, and the like.

With regard to the start assister 10 composed as mentioned above, at the time of low temperature, the piston 46 is slid upward to close the sub port 42, whereby the beginning of fuel-discharging is not delayed, i.e., the fuel injection timing is advanced.

On the other hand, when the piston 46 slides downward to bring the sub port 42 into communication with the fuel gallery 43, fuel oil in the fuel-compression chamber 44 is drained to the fuel gallery 43, so that the beginning of fuel-discharging is delayed, i.e., the fuel injection timing is not advanced.

While the piston 46, operated with the telescopic pin 61*a* of the thermo-element 61 through the connection pin 61, slides in the upper and lower chambers 49 and 48 in communication with the fuel gallery 43, components of the thermo-element 61, i.e., the telescopic pin 61*a*, the main body 61*d*, the cover 61*e*, and the like are arranged in the low-pressured chamber 50 separated from the upper and lower chambers 49 and 48 so as not to be subjected to fluctuation of pressure generated in the upper and lower chambers 49 and 48. Namely, the components of the thermo-element 60 are subjected to only pressure in the low-pressure chamber 50 almost as high as the atmospheric pressure.

Incidentally, the pulsating pressure in the fuel gallery 43, for example, which occurs by the trochoid pump for feeding fuel oil, is transmitted to the upper and lower chambers 49 and 48, thereby causing the fluctuation of pressure applied to the upper and lower chambers 49 and 48.

Therefore, fuel oil is not admitted into the main body 61*d* of the thermo-element 61 and a gap between the telescopic pin 61*a* and the sleeve 61*b*, whereby the thermo-element 61 is prevented from being functionally deteriorated and being damaged, thereby enhancing its reliability.

Additionally, by selecting the connection pin 62 having a diameter suitable to be connected to the telescopic pin 61*a* of the thermo-element 61 and the piston 46, load onto the thermo-element 60 caused by the fluctuation of pressure in the upper and lower chambers 49 and 48 can be lowered so as to prevent the thermo-element 61 from being functionally deteriorated and being damaged, thereby enhancing its reliability.

A stopper 61*f* is formed at the lower end of the telescopic pin 61*a*. When the telescopic pin 61*a* is contracted, the stopper 61*f* abuts against the bottom end surface of the cover 61*e* so as to keep the telescopic pin 61*a* from further sliding in its contracting direction, whereby the contracting force of the telescopic pin 61*a* to be applied to the connection pin 62 is received by the stopper 61*f* and the bottom end surface of the cover 61*e*.

Accordingly, the contracting force of the telescopic pin 61*a* is not applied to the sleeve 61*b* and others inside the thermo-element 61, so that the thermo-element 61 is prevented from being functionally deteriorated and being damaged, thereby enhancing its reliability.

Figure 3:
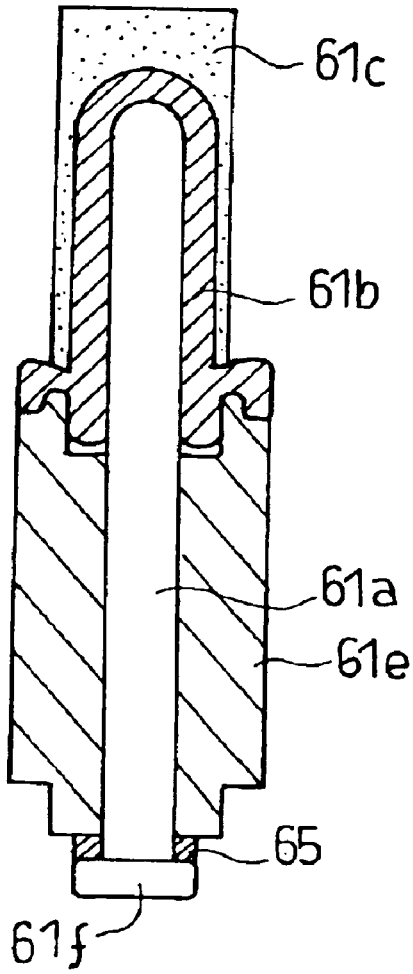
FIG. 3 is a sectional side view of a seal member arranged between a stopper of a telescopic pin and its cover.

A seal member 65 made of rubber, synthetic resin or the like may be interposed between the stopper 61*f* and the bottom surface of the cover 61*e*, as shown in FIG. 3. The seal member 65 is attached to the stopper 61*f* side, for example, but it may be attached to the bottom surface of the cover 61*e*.

When the telescopic pin 61*a* is contracted, the wax 61*c* does not press the sleeve 61*b* in the direction to push out the pin 61*a*, so that fuel oil is apt to be introduced into an opening between the telescopic pin 61*a* and the sleeve 61*b* when fuel oil pressure is applied. The seal member 65 interposed between the stopper 61*f* and the bottom surface of the cover 61*e* prevents the entrance of fuel oil into the opening between the telescopic pin 61*a* and the sleeve 61*b*.

The entrance of fuel oil into the opening between the telescopic pin 61*a* and the sleeve 61*b* changes the bottom end position of the contracted telescopic pin 61*a* so as to change the opening and closing timings of the sub port. The above arrangement prevents this entrance of fuel oil functionally deteriorating and damaging the thermo-element 61, thereby enhancing reliability of the thermo-element 61.

The thermo-element 61 is arranged above the piston 46 in this embodiment. Alternatively, the thermo-element 61 may be arranged below the piston 46.

The present start assister 10 can have optional exchange of only an actuator for driving the piston 46.

Figure 4:
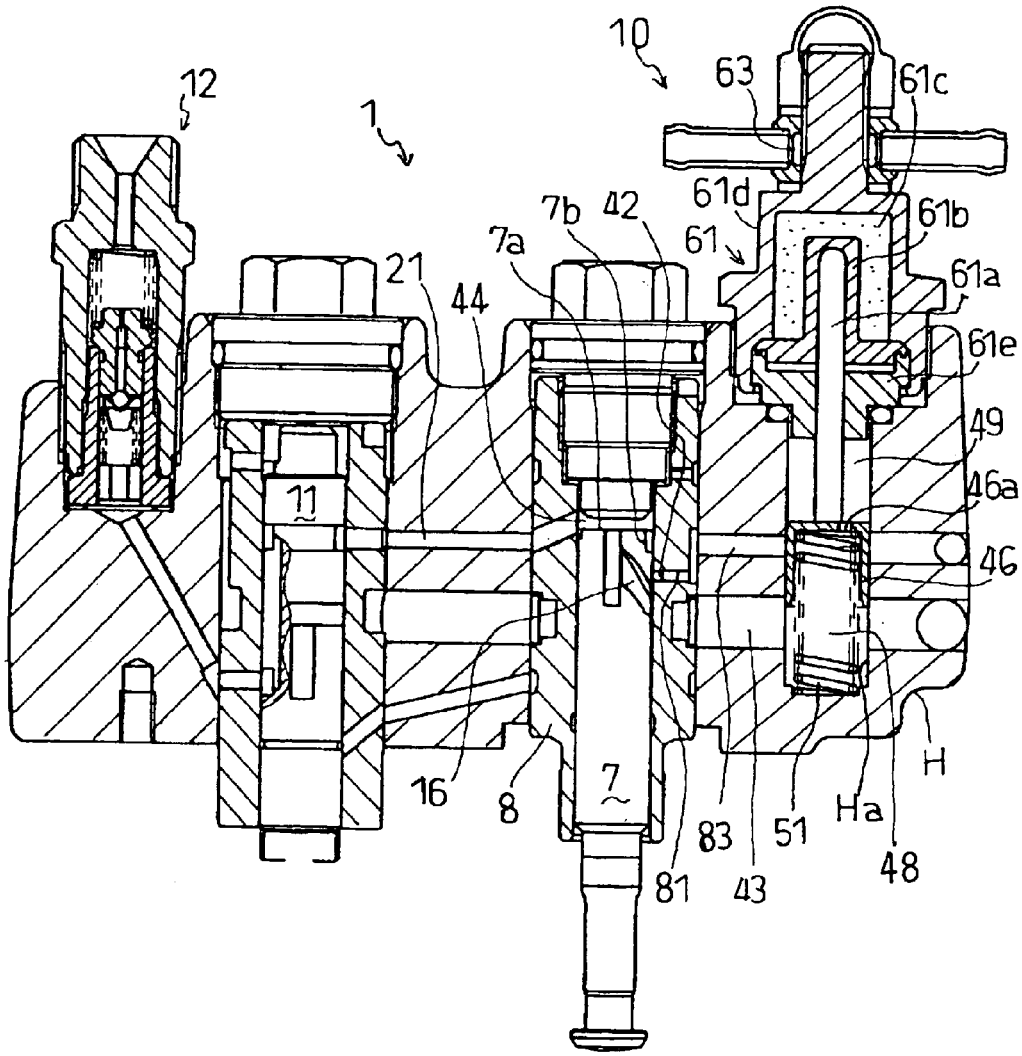
FIG. 4 is a sectional side view of a fuel injection pump comprising a start assister in which a thermo-element is installed as an actuator for driving the piston.
Figure 5:
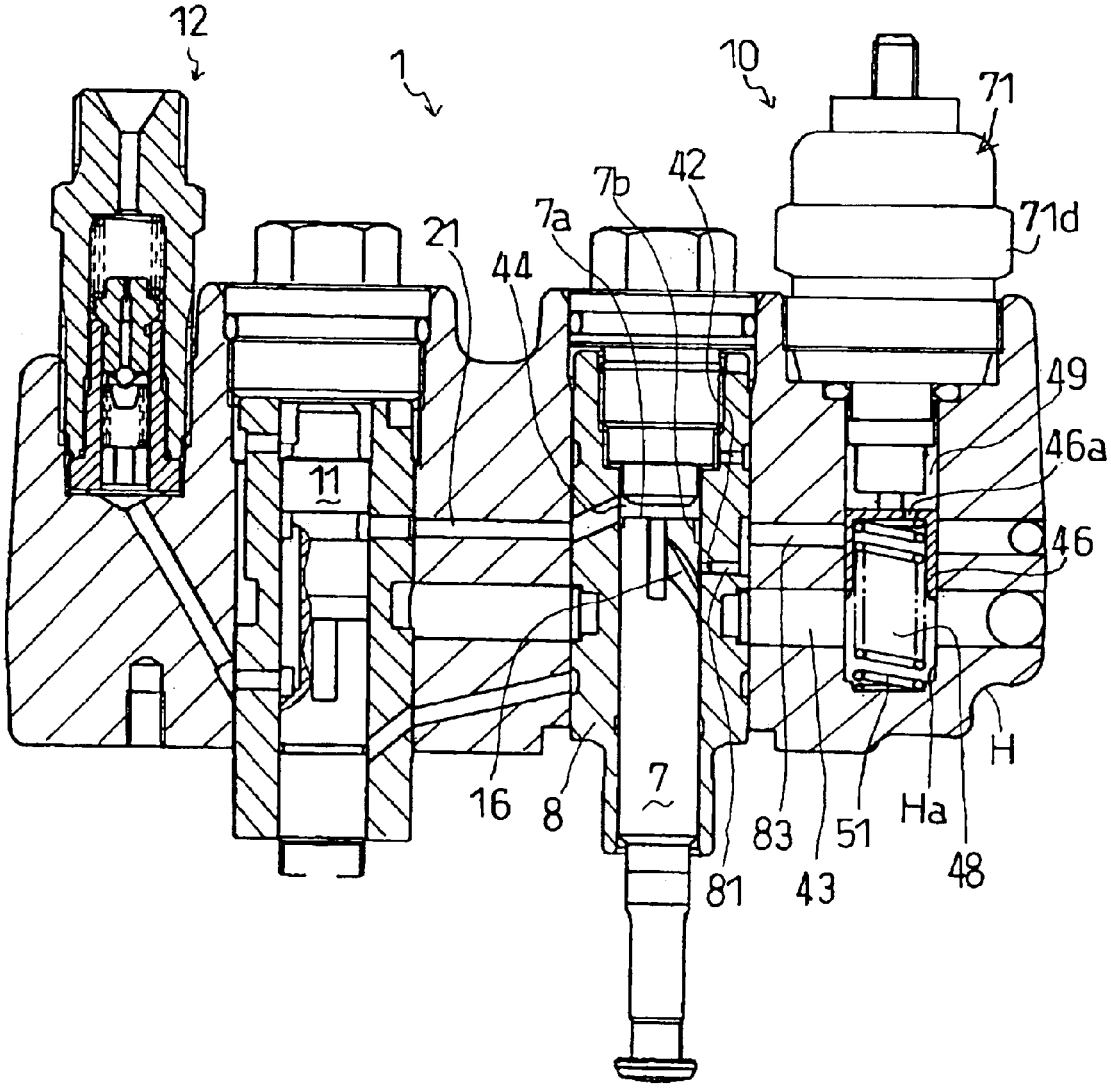
FIG. 5 is a sectional side view of a fuel injection pump comprising a start assister in which a solenoid is installed as an actuator for driving the piston.

For instance, the start assister 10 having the housing H in which the thermo-element 60 serving as the actuator for driving the piston 46 is installed as shown in FIG. 4 can change its specification only by replacing the thermo-element 60 with a solenoid 71 shown in FIG. 5.

Each of the thermo-element 61 and the solenoid 71 is screwed into the housing H. The thermo-element 61 and solenoid 71 have respective main bodies 61 and 71, which are provided at their lower portions with standardized tapped holes.

In this way, the thermo-element 61, the solenoid 71 and the like serve as exchangeable actuators, one of which can be selectively installed in the housing H, thereby providing a fuel injection timing advancing structure suitable to any of various uses.

Figure 6:
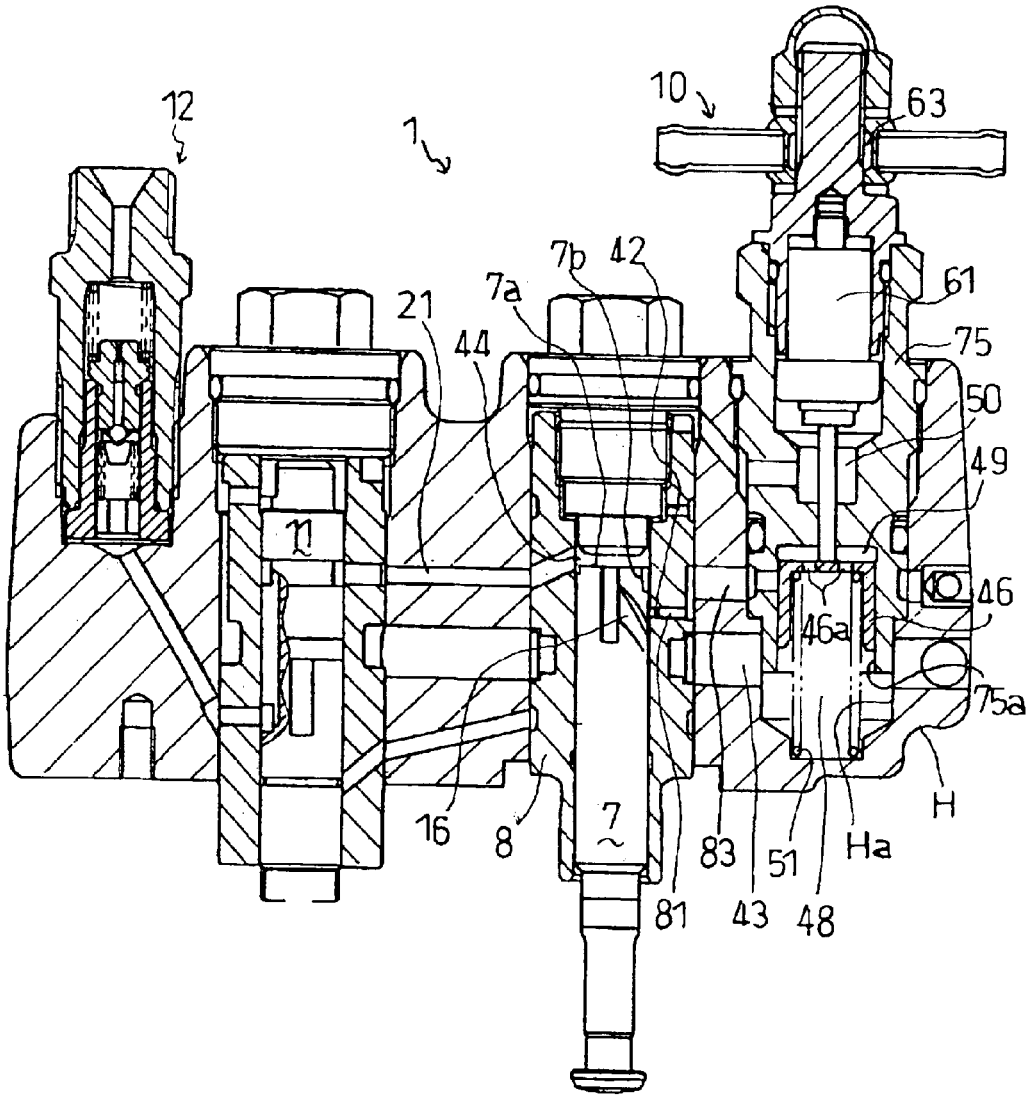
FIG. 6 is a sectional side view of a fuel injection pump comprising a start assister wherein a thermo-element is applied as an actuator for driving the piston and function members are made into a unit.

Alternately, as shown in FIG. 6, the piston 46, the thermo-element 61 and others serving as members constituting the start assister 10 may be assembled together in a spindle barrel 75 so as to form a unit detachably fitted into the housing H.

In this case, the unit is installed by screwing the spindle barrel 75 into the housing H, so as to constitute the low-pressure chamber in the spindle barrel 75. The piston 46 is slidably inlayed into a recessed portion 75*a* at the bottom end of the spindle barrel 75, so as to be driven by the telescopic pin 61*a* of the thermo-element 61.

Figure 7:
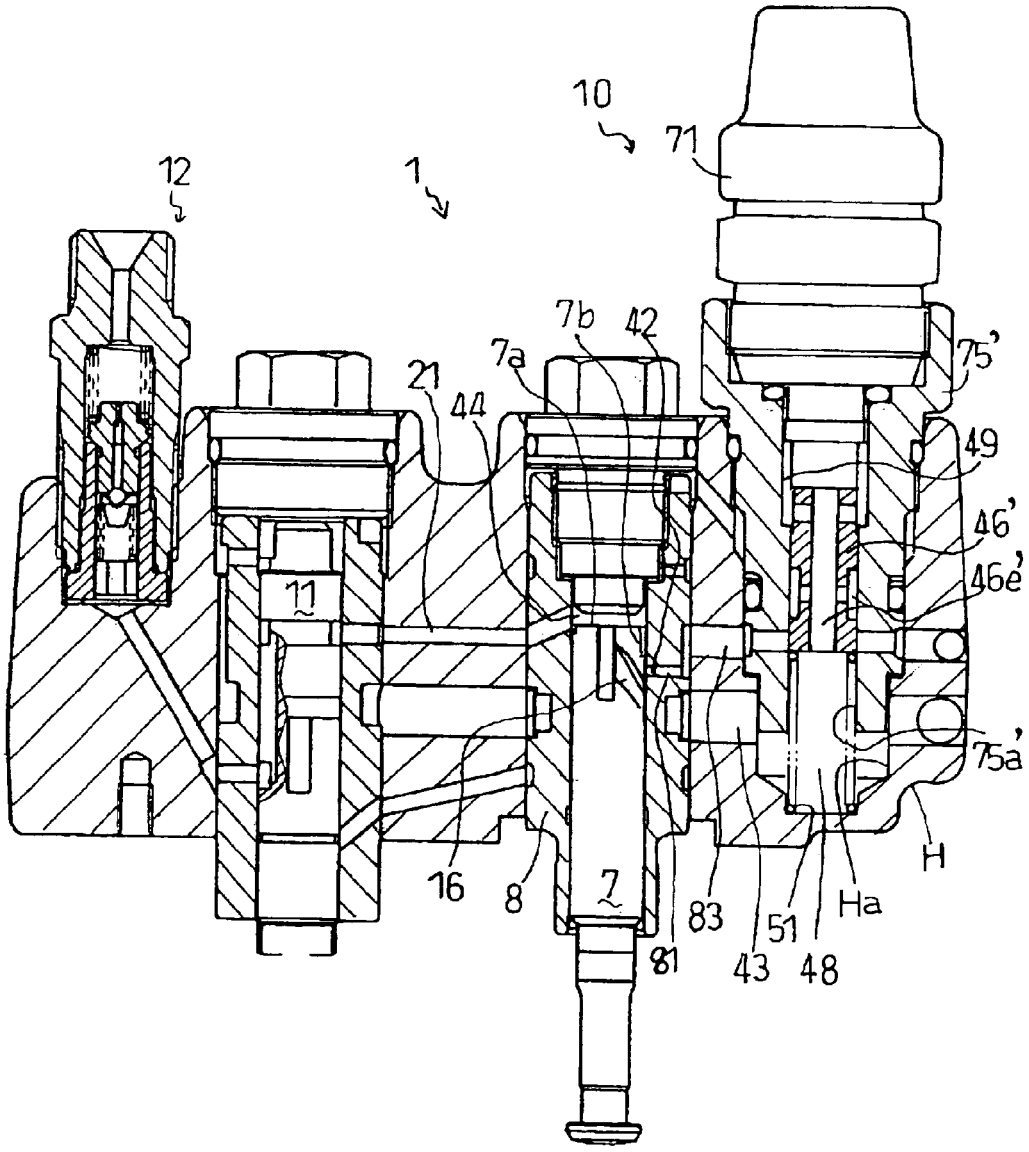
FIG. 7 is a sectional side view of a fuel injection pump comprising a start assister wherein a solenoid is applied as an actuator for driving the piston and function members are made into a unit.

Also, in case the solenoid 71 serves as the actuator for driving the piston 46, as shown in FIG. 7, the piston 46', the solenoid 71, and the like serving as members constituting the start assister 10 may be assembled integrally in a spindle barrel 75' so as to form a unit detachably installed in the housing H.

In this case, the unit is installed by screwing the spindle barrel 75' to the housing H. The piston 46' is slidably inlayed into an inlay-hole 75*a*' of the spindle barrel 75', so as to be driven by the solenoid 71.

When the piston 46' is slid upward by the spring 51, the drain passage 83 is closed by a periphery of the piston 46'. When the piston 46' slides downward, the drain passage 83 is brought into communication with the fuel gallery 43 through a communication hole 46*e*' of the piston 46'.

The unit as assembly of the piston 46, the thermo-element 61 and the like in the spindle barrel 75 and the unit as assembly of the piston 46', the solenoid 71 and the like in the spindle barrel 75' are exchangeable corresponding to needs, so as to be installed in the housing H.

The function members of the start assister 10 are unified so as to provide a unit having function and precision ensuring enhanced reliability.

Any suitable one of exchangeable various units having different actuators such as the thermo-element and the solenoid is selected and installed in the housing H so as to have injection-time-advancing control at start-up time corresponding to use.

Next, description will be given of a structure of a fuel injection pump shown in FIG. 8, wherein the start assister is modified so that the upper and lower chambers communicate with the fuel gallery through only an inlay-gap between the piston and the housing.

Figure 8:
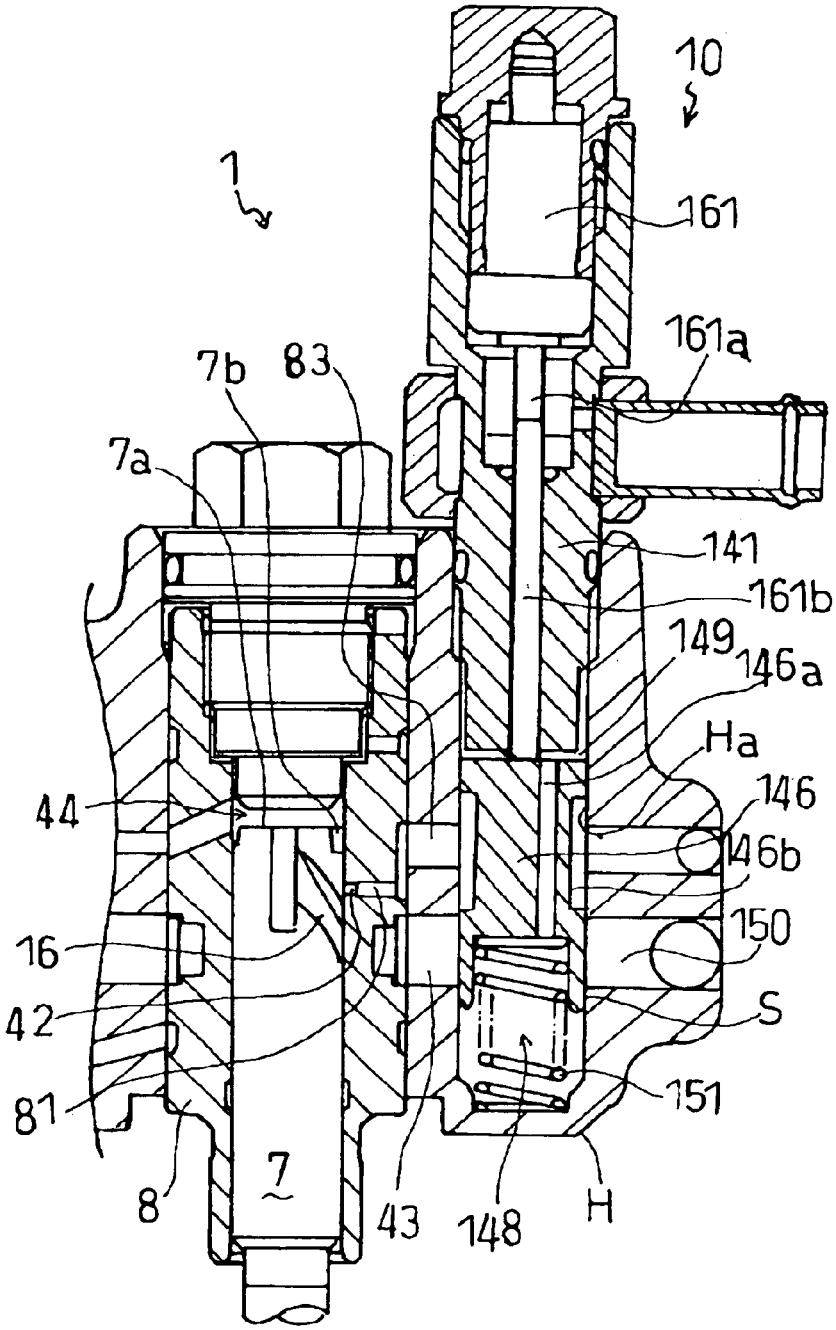
FIG. 8 is a sectional side view of a fuel injection pump comprising a start assister according to the present invention.

The fuel injection pump 1 shown in FIG. 8 has the plunger 7 portion configured almost similar to that of the above-mentioned fuel injection pump 1 shown in FIGS. 1 and 2. Description of members of the fuel injection pump 1 and its start assister 10 shown in FIG. 8, which are designated by the same reference numerals with those of FIGS. 1 and 2, are omitted.

In a portion of the housing H beside the plunger barrel 8 is formed the inlay-hole Ha having a lower portion into which a timer piston 146 is vertically slidably inserted so as to have a predetermined inlay-gap S therebetween.

A space under the timer piston 146 in the inlay-hole Ha is made as a lower chamber 148, and a space over the timer piston 146 is made as an upper chamber 149. The lower chamber 148 communicates with the upper chamber 149 through a communication hole 146*a* vertically penetrating the timer piston 146.

The oil passage 81 in communication with the sub port 42 is arranged in the radial direction in the plunger barrel 8 so as to communicate with the inlay-hole Ha through the drain passage 83 formed in the housing H.

The timer piston 146 is biased upward by a spring 151. A thermo-element 161 serving as a temperature-sensing member is arranged above the timer piston 146, and fastened to a supporter 141 inserted into the inlay-hole Ha.

The thermo-element 161 has a downwardly extended telescopic piston 161*a* abutting against the top surface of the timer piston 146 through a pin 161*b*.

The telescopic pin 161*a* is contracted at a low temperature state where temperature is not higher than a preset temperature. When the low temperature state turns into a high temperature state where the temperature is not lower than the preset temperature, the telescopic pin 161*a* is expanded so as to downwardly slide the timer piston 146 essentially slid upward by biasing of the spring 151.

On the other hand, if the high temperature state returns to the low temperature state, the timer piston 146 slides upward by the biasing force of the spring 151 so as to contract the telescopic pin 161*a*.

The present start assister 10 of the fuel injection pump 1 comprises the timer piston 146, the lower chamber 148, the upper chamber 149, a high-pressure chamber 150, the communication passage 83, the spring 151, and the like.

The fuel gallery 43 has an opening toward the inlay hale Ha, which is closed by the side surface of the timer piston 146. The drain passage 83 also has an opening toward the inlay hale Ha, which is closed by the side surface of the timer piston 146.

In a state of the timer piston 146 having slid upward (shown in FIG. 8), the timer piston 146 separates the fuel gallery 43 from the drain passage 83. When the telescopic pin 161*a* of the thermo-element 161 is expanded and the timer piston 146 slides downward, the fuel gallery 43 and the drain passage 83 are brought into communication with each other through a recessed groove 146*b* formed at a periphery of the timer piston 146.

The high-pressure chamber 150 having an opening toward the side surface of the piston is formed in the housing H opposite to the fuel gallery 43.

The inlay-gap S is ensured between the timer piston 146 and the housing H so as to bring the lower and upper chambers 148 and 149 into communication with the drain passage 83 through the inlay-gap S. Accordingly, when the sub port 42 is closed by the timer piston 146, fuel oil in the fuel-compression chamber 44 pressurized by the plunger 7 leaks out to the lower chamber 148 and the upper chamber 149 from the inlay-gap S, so that the pressure in the lower and upper chambers 148 and 149 is accumulated at the level of fuel injection pressure in the fuel-compression chamber 44.

The high-pressure chamber 150 also communicates with the lower chamber 148 and the upper chamber 149 through the inlay-gap S so as to accumulate pressure leveled with the fuel injection pressure in the fuel-compression chamber 44.

The lower chamber 148 and the upper chamber 149 communicate with the fuel gallery 43 through the inlay-gap S.

Since the high-pressure chamber 150 accumulating the fuel injection pressure is arranged opposite to the fuel gallery 43, the pressure in the high-pressure chamber 150 presses the timer piston 146 toward the fuel gallery 43 side.

Accordingly, the inlay-gap S between the timer piston 146 and the inner side surface of the inlay-hole Ha on the fuel gallery 43 side is shortened, so that both of them contact together, thereby improving the sealing between the fuel gallery 43 and the upper and lower chambers 149 and 148. Therefore, the pressure accumulated in the lower chamber 148, the upper chamber 149, and the high-pressure chamber 150 is maintained.

Figure 9:
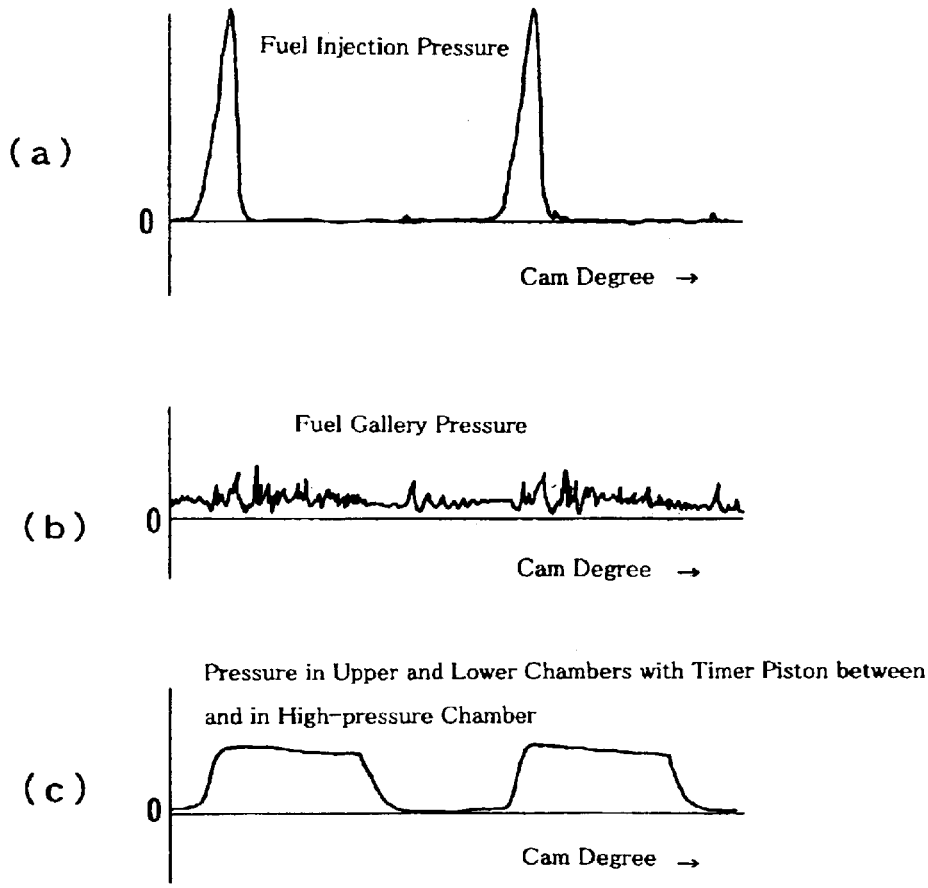
FIG. 9 shows pressures at respective portions of a fuel injection pump comprising a start assister according to the present invention: (a) is a graph of fuel injection pressure in a fuel-compression chamber caused by a plunger; (b) is a graph of fuel gallery pressure; and (c) is a graph of pressure in a lower chamber, an upper chamber, and a high-pressure chamber.

To put it concretely, FIG. 9(*a*) shows fuel injection pressure in the fuel-compression chamber 44 caused by the plunger 7, FIG. 9(*b*) shows fuel gallery pressure, and FIG. 9(*c*) shows pressure in the lower chamber 148, the upper chamber 149, and the high-pressure chamber 150.

In this case, while fuel injection pressure is increased by the plunger 7, the fuel injection pressure leaks out through the inlay-gap S and accumulated in the lower chamber 148, the upper chamber 149, and the high-pressure chamber 150, so that the pressure in these chambers 148,149,150 is increased and then maintained for a determined time. The increased pressure in the lower chamber 148, the upper chamber 149, and the high-pressure chamber 150 is higher than the pressure in the fuel gallery 43.

Thus, the injection pressure accumulated in the lower chamber 148, the upper chamber 149, and the high-pressure chamber 150 is kept at such a high level as to advance the injection timing at a degree larger than the advanced timing when the lower chamber 148 and the upper chamber 149 communicate with the fuel gallery 43 through drilled bores or the like.

Figure 10:
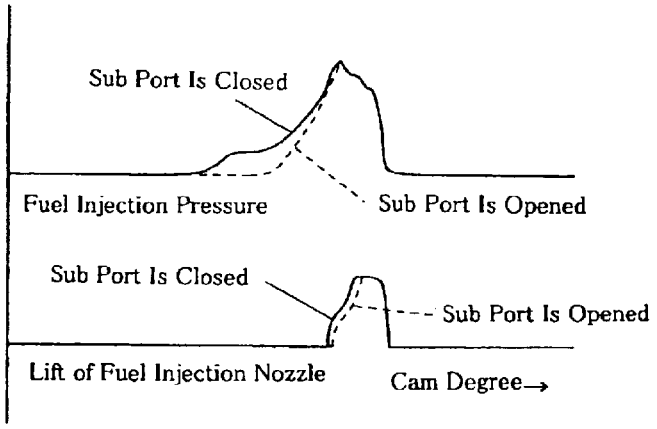
FIG. 10 shows fuel injection pressure in the fuel-compression chamber and lift of an injection nozzle when the fuel injection timing is advanced: (a) illustrates an effect of advancing the fuel injection timing when the lower and upper chambers communicate with the fuel gallery through a drilled bore or the like; and (b) illustrates an effect of advancing the fuel injection timing when the lower and upper chambers communicate with the fuel gallery through only an inlay-gap.
Figure 10:
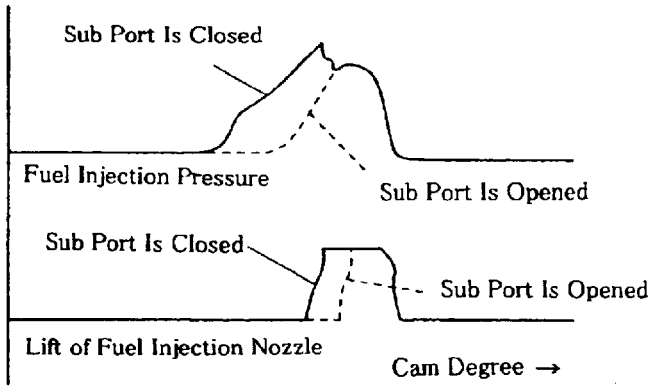

It is assumed that the lower and chambers 148 and 149 communicate with the fuel gallery 43 through drilled bores, for example, as shown in FIG. 10(*a*). Both of fuel injection pressure in the fuel-compression chamber 44 and lift of a fuel injection nozzle, when the sub port 42 is closed to advance the fuel injection timing, are changed at a little degree from those when the sub port 42 is opened.

On the other hand, if the lower and chambers 148 and 149 communicate with the fuel gallery 43 through only the inlay-gap S, as shown in FIG. 10(*b*), both of fuel injection pressure in the fuel-compression chamber 44 and lift of a fuel injection nozzle, when the sub port 42 is closed to advance the fuel injection timing, are changed largely from those when the sub port 42 is opened.

As mentioned above, with respect to the lower and upper chambers 148 and 149 in communication with the fuel gallery 43 through only the inlay-gap S between the housing H and the timer pin 146, when the sub port 42 is closed, fuel injection pressure leaks out through the inlay gap S so as to accumulate pressure in the lower and upper chambers 148 and 149, thereby easily increasing the pressure in the fuel-compression chamber 44 so as to enhance the effect of advancing the fuel injection timing.

Further, the high-pressure chamber 150 opposite to the fuel gallery 43 and open toward the side surface of the timer piston 146 is formed in the housing H so as to communicate with the upper and lower chambers 149 and 148 through the inlay-gap S between the housing H and the timer piston 146, thereby pressing the timer piston 146 against the inner side surface of the inlay-hole Ha facing the open side of the fuel gallery 43 so as to improve the sealing between the fuel gallery 43 and the upper and lower chambers 149 and 148.

Therefore, the pressure accumulated in the lower 148 chamber and the upper chamber 149 can be preserved so as to enhance the efficiency of advancing fuel injection timing.

Even if the volume of the inlay-gap S between the inlay-hole Ha and the timer piston 146 is changed, the improved sealing between the fuel gallery 43 and the upper and lower chambers 149 and 148 is still ensured for having steady effect of advancing fuel injection timing.

Industrial Applicability

As understood from the above description, the start assister according to the present invention is applicable to a fuel injection pump used for a diesel engine and so forth.

What is claimed is:

1. A start assister of a fuel injection pump, comprising:

a piston slidably installed in a housing;

an upper chamber formed over the piston;

a lower chamber formed under the piston;

a sub port opened and closed by sliding of the piston, wherein a fuel injection timing is advanced by closing the sub port;

a temperature-sensing member for sliding the piston being arranged on one side in the piston-sliding direction;

a telescopic pin of the temperature-sensing member arranged in a low-pressure chamber divided into the upper chamber and the lower chamber; and a connection pin interposed between the telescopic pin and the piston.

2. The start assister of a fuel injection pump as set forth in claim 1, further comprising:

a stopper formed by either the telescopic pin or the connection pin so as to prevent the telescopic pin from being contracted shorter than its telescopic stroke.

3. The start assister of a fuel injection pump as set forth in claim 2, further comprising:

a seal member interposed between the stopper and the temperature-sensing member so as to seal an inside of a main body of the temperature-sensing member from the lower-pressure chamber.

4. A start assister of a fuel injection pump, comprising:

a sub port for draining a part of fuel oil admitted into a plunger barrel from a fuel gallery;

a drain passage connected to the sub port;

a piston for opening and closing the drain passage being slidably inlayed into a housing so as to have an inlay-gap between the piston and the housing, wherein the piston closes the sub port so as to advance fuel injection timing;

an upper chamber formed over the piston; and a lower chamber formed under the piston, wherein the upper chamber and the lower chamber communicate with the fuel gallery through only the inlay-gap between the housing and the piston.

5. The start assister of a fuel injection pump as set forth in claim 4, wherein the fuel gallery is open toward a side surface of the piston, and wherein a high-pressure chamber is formed in the housing so as to be open toward a side surface of the piston opposite to the fuel gallery and to communicate with the upper chamber and the lower chamber through the inlay-gap between the housing and the piston.

6. A fuel injection pump comprising:

a housing fanned therein with a fuel-compression chamber fitting a plunger therein, a sub port for leaking fuel from the fuel-compression chamber, and a hole in communication with the sub port;

a first start assister including a piston for opening and closing the sub port, wherein the piston closes the sub port so as to advance fuel injection timing, and a temperature-sensing member serving as an actuator for the piston; and a second start assister including a piston for opening and closing the sub port, wherein the piston closes the sub port so as to advance fuel injection timing, and a solenoid serving as an actuator for the piston, wherein either the first or second start assister is selectively detachably fitted into the hole formed in the housing.

* * * * *